US009587601B1

(12) United States Patent
Ochiai

(10) Patent No.: US 9,587,601 B1
(45) Date of Patent: Mar. 7, 2017

(54) OUTBOARD MOTOR AND WATERCRAFT

(71) Applicant: YAMAHA HATSUDOKI KABUSHIKI KAISHA, Iwata-shi, Shizuoka (JP)

(72) Inventor: Katsumi Ochiai, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/855,528

(22) Filed: Sep. 16, 2015

(51) Int. Cl.

| | |
|---|---|
| ***F01P 1/02*** | (2006.01) |
| ***F02M 35/16*** | (2006.01) |
| ***B63H 20/00*** | (2006.01) |
| ***F02B 75/22*** | (2006.01) |

(52) U.S. Cl.
CPC ..... *F02M 35/167* (2013.01); *B63H 20/00* (2013.01); *F01P 1/02* (2013.01); *F02B 75/22* (2013.01)

(58) Field of Classification Search
CPC .... F01P 1/02; F01P 11/00; F01P 11/12; F01P 3/20; F02B 61/00; F02B 61/04
USPC ..... 440/88 A; 123/41.7, 198 E
See application file for complete search history.

(56) References Cited

U.S. PATENT DOCUMENTS 5,070,686 A * 12/1991 Isaka ..... F01P 1/02 123/41.58
2004/0149241 A1 8/2004 Shomura et al.

FOREIGN PATENT DOCUMENTS

JP 2004-239156 A 8/2004
JP 2010-138856 A 6/2010

* cited by examiner

*Primary Examiner* — Lars A Olson
(74) *Attorney, Agent, or Firm* — Keating and Bennett, LLP

(57) ABSTRACT

An outboard motor includes an engine, a flywheel magnet generator, a fan, and a cover member. The engine includes a crankshaft extending in a vertical direction. The flywheel magnet generator includes a flywheel rotor, a core, and a coil. The flywheel rotor is attached to an end of the crankshaft. The core and the coil are disposed between the flywheel rotor and the engine. The fan is attached onto the flywheel rotor. The cover member is disposed above the fan. The cover member includes a first suction port that sucks in air from above the cover member. The flywheel rotor includes a second suction port that sucks in air from below the flywheel rotor. The fan includes a first ventilation path and a second ventilation path. The first ventilation path radially outwardly releases the air sucked in through the first suction port, whereas the second ventilation path radially outwardly releases the air sucked in through the second suction port.

13 Claims, 16 Drawing Sheets

OUTBOARD MOTOR AND WATERCRAFT

BACKGROUND OF THE INVENTION

1. Field of the Invention

The present invention relates to an outboard motor including an intake path to direct external air to an engine, and to a watercraft including the outboard motor.

2. Description of the Related Art

To cool a flywheel magnet generator (hereinafter referred to as "a generator") attached to a crankshaft of an engine, a method of attaching a fan to a position above a flywheel rotor of the generator has been conventionally known (see Japan Laid-open Patent Application Publication No. 2004-239156).

On the other hand, to ventilate the interior of an engine cover that accommodates the engine, a method of attaching a fan to the crankshaft of the engine has been known (see Japan Laid-open Patent Application Publication No. 2010-138856).

However, in the methods disclosed in Japan Laid-open Patent Application Publications Nos. 2004-239156 and 2010-138856, a single fan cannot perform both cooling of the generator and ventilation of the interior of the engine cover.

SUMMARY OF THE INVENTION

Preferred embodiments of the present invention provide an outboard motor including a single fan that is capable of both cooling a flywheel magnet generator and ventilating an interior of an engine cover, and a watercraft including the outboard motor.

An outboard motor according to a preferred embodiment of the present invention includes an engine, a flywheel magnet generator, a fan, and a cover member. The engine includes a crankshaft extending in a vertical direction. The flywheel magnet generator includes a flywheel rotor, a core, and a coil. The flywheel rotor is attached to an end of the crankshaft. The core and the coil are disposed between the flywheel rotor and the engine. The fan is attached to the flywheel rotor. The cover member is disposed above the fan. The cover member includes a first suction port that sucks in air from above the cover member. The flywheel rotor includes a second suction port that sucks in air from below the flywheel rotor. The fan includes a first ventilation path and a second ventilation path. The first ventilation path radially outwardly releases the air sucked in through the first suction port, whereas the second ventilation path radially outwardly releases the air sucked in through the second suction port.

According to preferred embodiments of the present invention, it is possible to provide an outboard motor including a single fan that is capable of both cooling a flywheel magnet generator and ventilating the interior of an engine cover, and a watercraft including the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will now be explained with reference to the drawings. It will be apparent to those skilled in the art from this disclosure that the following descriptions of the preferred embodiments are provided for illustration only and not for the purpose of limiting the present invention as defined by the appended claims and their equivalents.

Preferred embodiments will be hereinafter explained with reference to the attached drawings.

Figure 1:
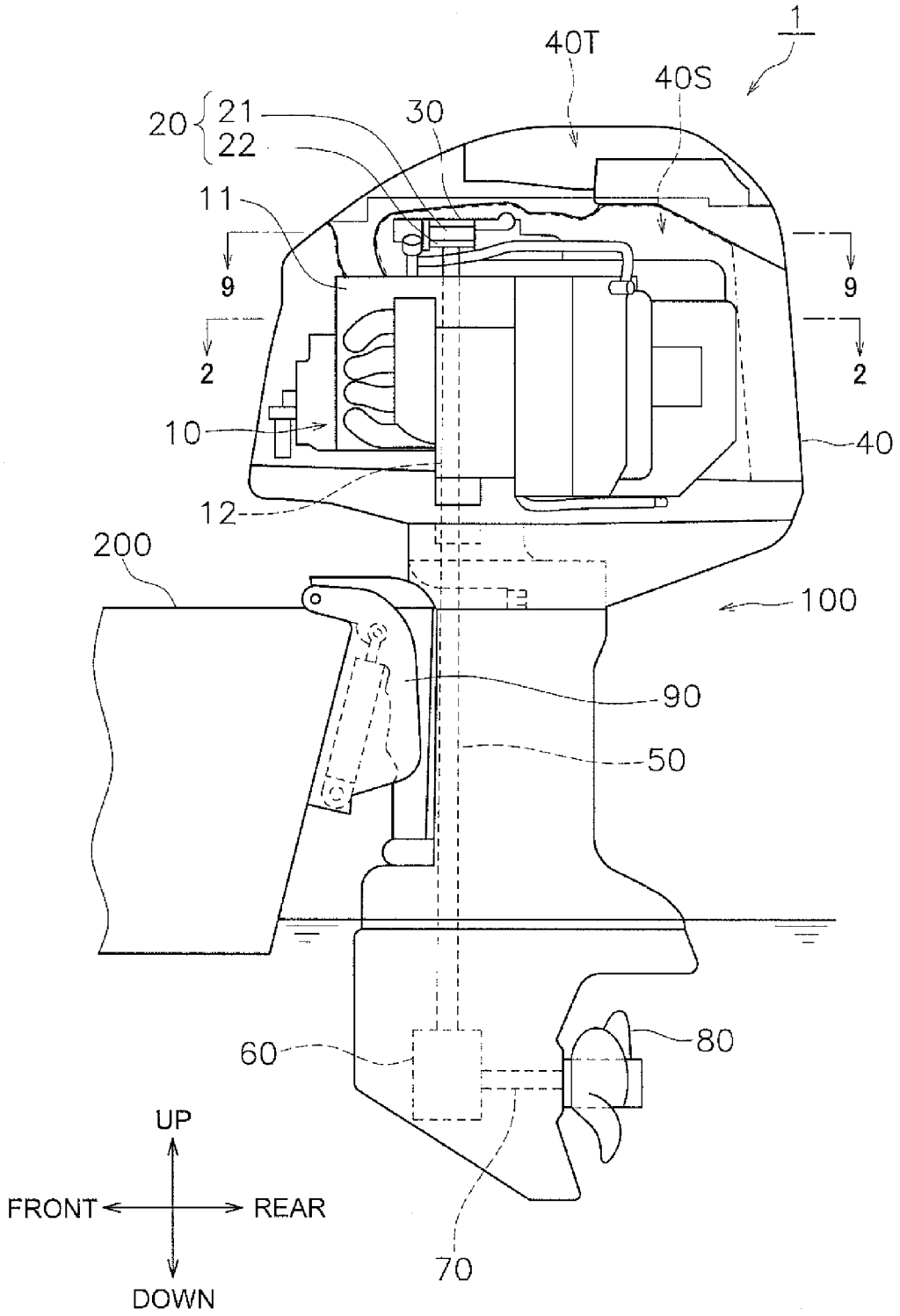
FIG. 1 is a side view of a watercraft.
Figure 2:
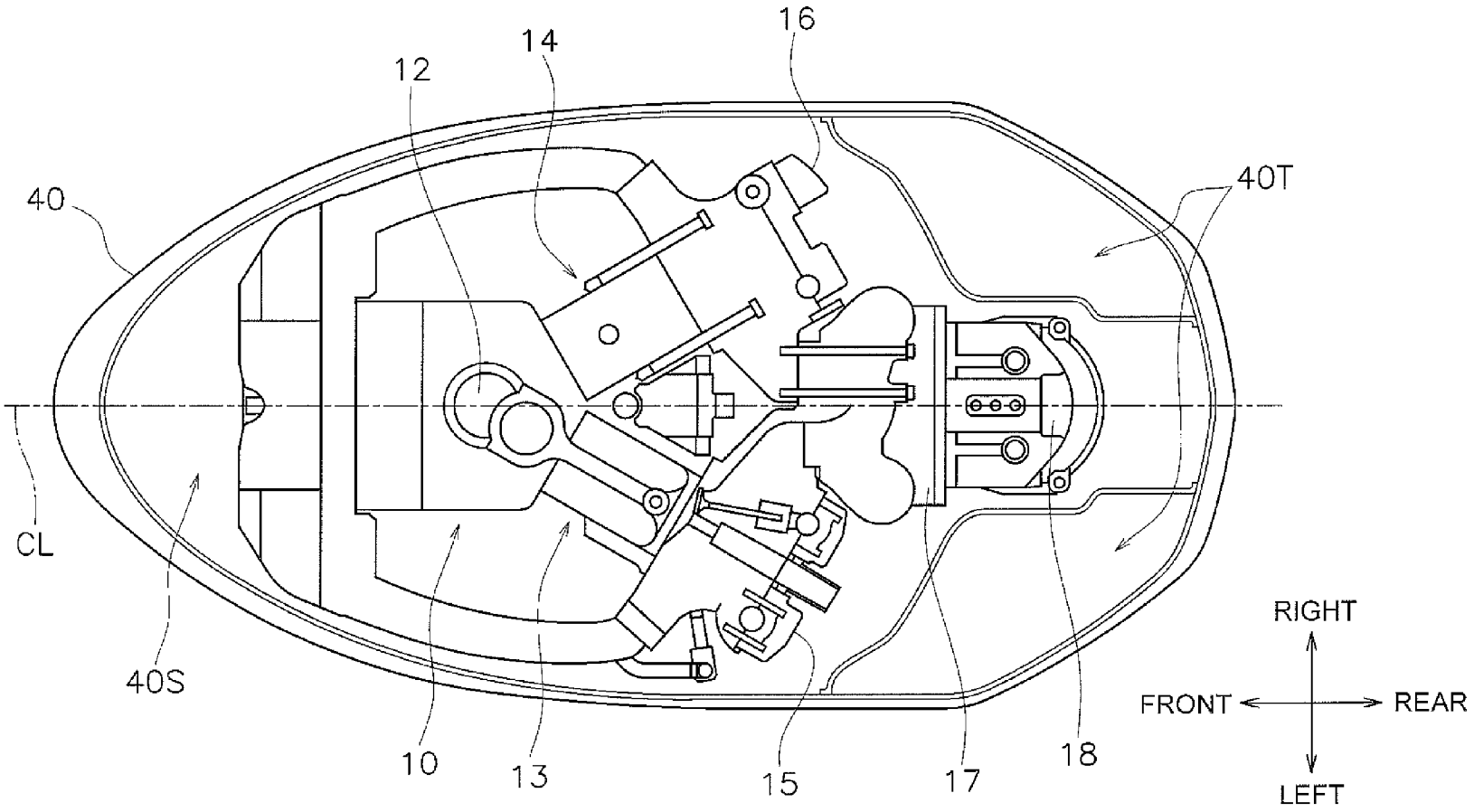
FIG. 2 is a cross-sectional view of FIG. 1 taken along line 2-2.

FIG. 1 is a side view of a watercraft 1 according to a preferred embodiment of the present invention. As shown in FIG. 1, the watercraft 1 includes an outboard motor 100 and a hull 200. FIG. 2 is a cross-sectional view of FIG. 1 taken along line 2-2.

The outboard motor 100 is used as a propulsion device for the hull 200. The outboard motor 100 is attached to a rear end of the hull 200. The outboard motor 100 includes an engine 10, a flywheel magnet generator 20, a fan 30, an engine cover 40, a drive shaft 50, a shift mechanism 60, a propeller shaft 70, a propeller 80, and a bracket 90.

The engine 10 is preferably a V-type eight-cylinder engine, for example, that burns fuel to generate a driving force. The engine 10 is accommodated in an engine compartment 40S within the engine cover 40.

The engine 10 includes a throttle body 11, a crankshaft 12, four first cylinders 13, four second cylinders 14, a first head cover 15, and a second head cover 16. The crankshaft 12 extends in an up-and-down direction. The four first cylinders 13 are overlapped one above another, and obliquely extend rearward and leftward of the crankshaft 12. The four second cylinders 14 are overlapped one above another, and obliquely extend rearward and rightward of the crankshaft 12. Each of the first and second head covers 15 and 16 defines an exterior portion of the engine 10. The first head cover 15 is disposed rearward and leftward of the four first cylinders 13. The second head cover 16 is disposed rearward and rightward of the four second cylinders 14. In the present preferred embodiment, "right" and "left" are terms defined with reference to a right-and-left center line CL (see FIG. 2) of the engine 10 that passes through the center of the crankshaft 12.

As shown in FIG. 2, an exhaust pipe 17 is connected to the engine 10. The exhaust pipe 17 encloses a catalyst 18. The exhaust pipe 17 is disposed in the right-and-left middle of the outboard motor 100 and extends in the up-and-down direction. The catalyst 18 is disposed between the four first cylinders 13 and the four second cylinders 14 in the right-and-left direction.

The flywheel magnet generator 20 is preferably an AC generator that defines and functions as an auxiliary machine for the engine 10. The flywheel magnet generator 20 includes a flywheel rotor 21 and a stator 22. The construction of the flywheel magnet generator 20 will be described below.

The fan 30 is disposed above the flywheel magnet generator 20. The fan 30 is configured to suck in air from below after the air passes through the flywheel magnet generator 20 and also suck in air inside the engine compartment 40S from above. The fan 30 releases the air sucked therein. The construction of the fan 30 will be described below.

The engine compartment 40S and an intake path 40T are provided in the interior of the engine cover 40. The engine compartment 40S is a space that accommodates the engine 10. The intake path 401 directs external air to the throttle body 11. The intake path 40T is located above and rearward of the engine compartment 40S. The construction of the engine cover 40 and the construction of the intake path 40T will be described below.

The drive shaft 50 is connected to a lower end of the crankshaft 12, and is rotated by the driving force of the engine 10. The shift mechanism 60 switches the rotation of the propeller shaft 70 into any of a forward moving state, a neutral state, and a rearward moving state. The propeller 80 is attached to a rear end of the propeller shaft 70. The bracket 90 connects the outboard motor 100 to the hull 200. The bracket 90 supports the outboard motor 100 so as to make it pivotable back and forth and right and left.

Figure 3:
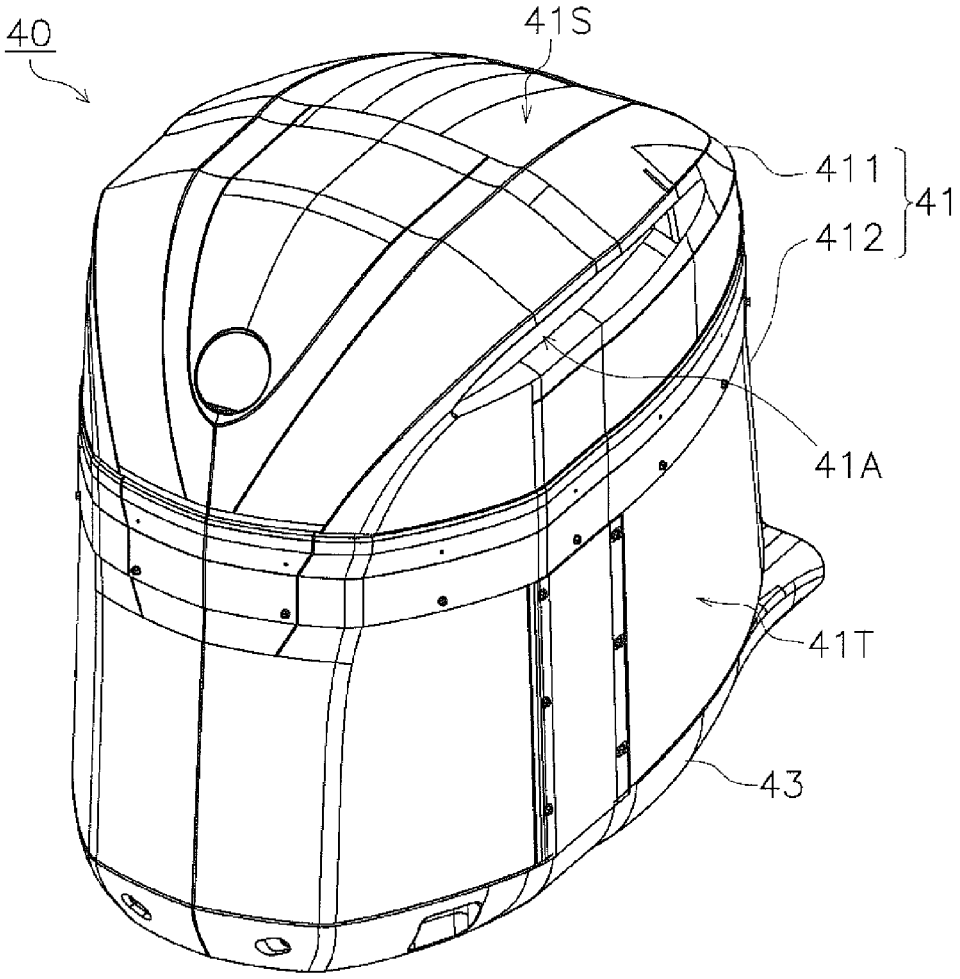
FIG. 3 is a rear perspective view of an engine cover.
Figure 4:
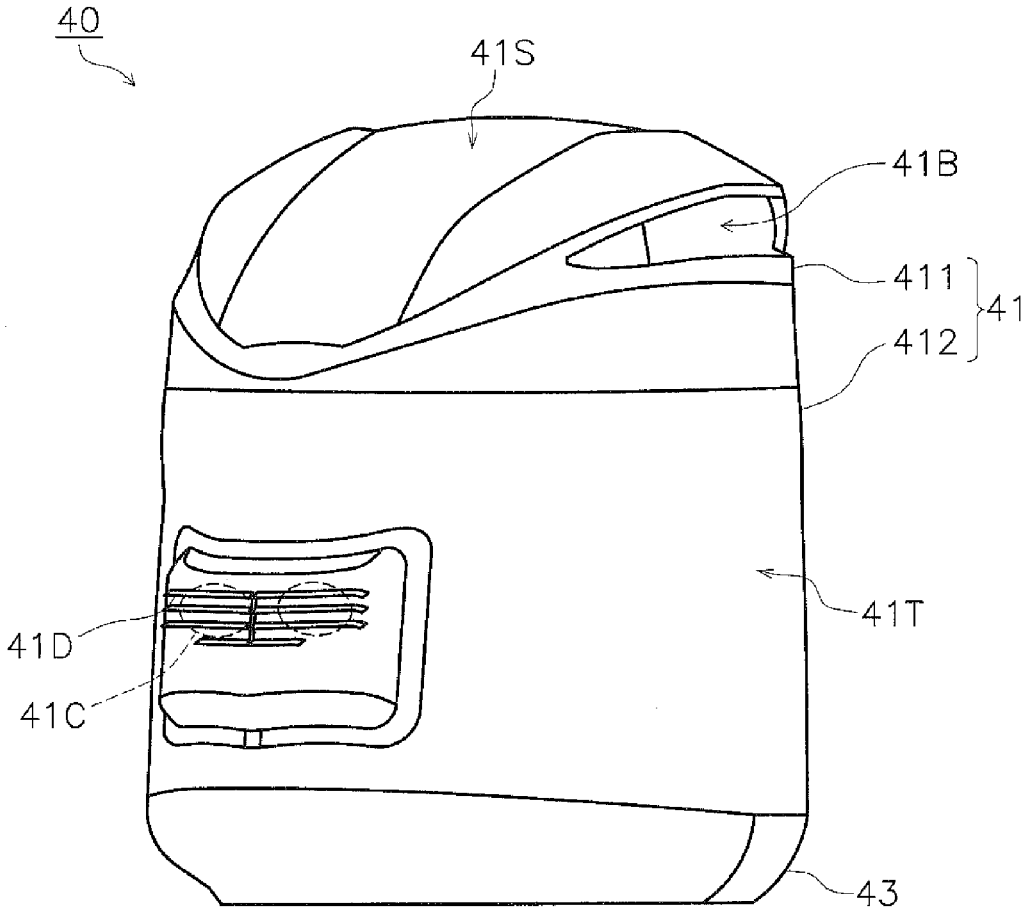
FIG. 4 is a front perspective view of the engine cover.
Figure 5:
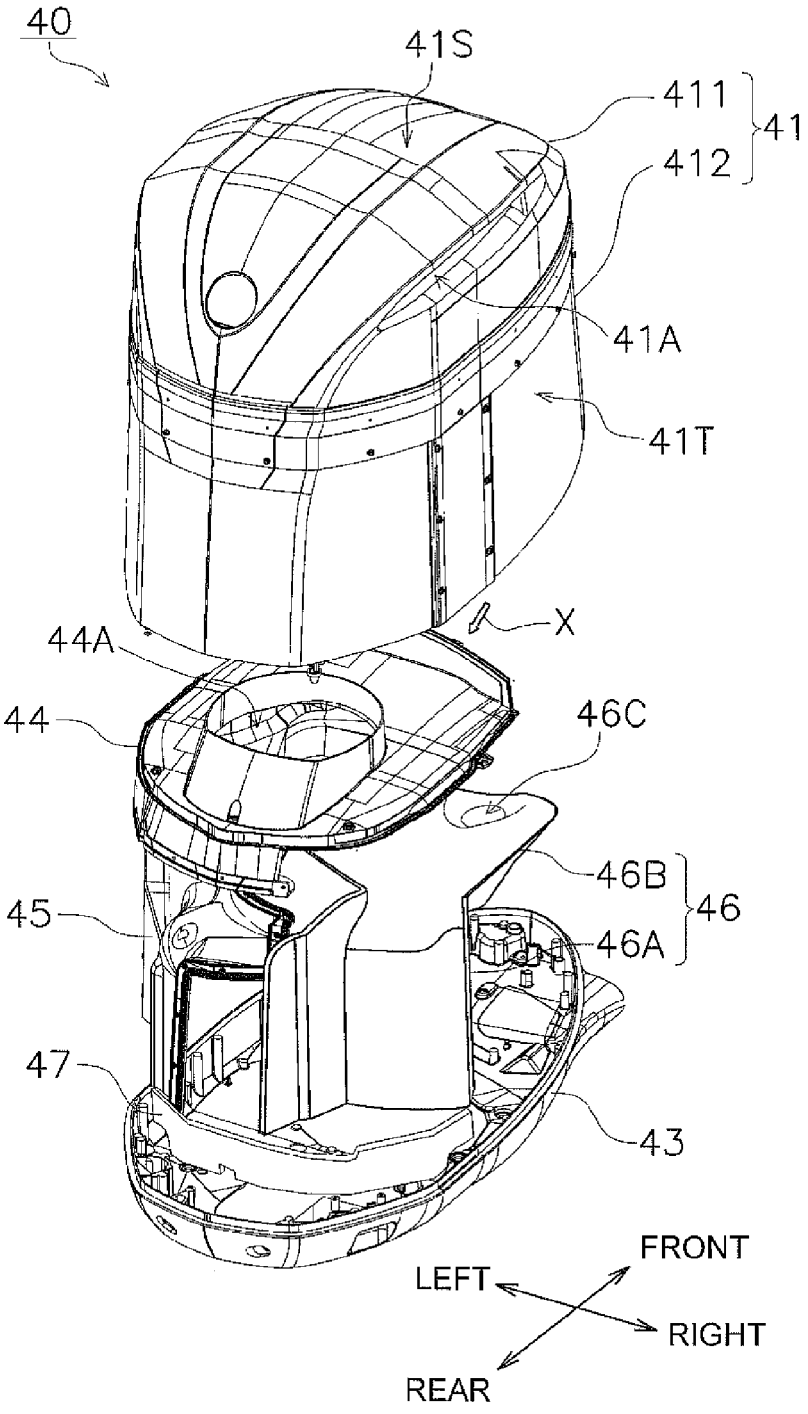
FIG. 5 is an exploded perspective view of the engine cover.
Figure 6:
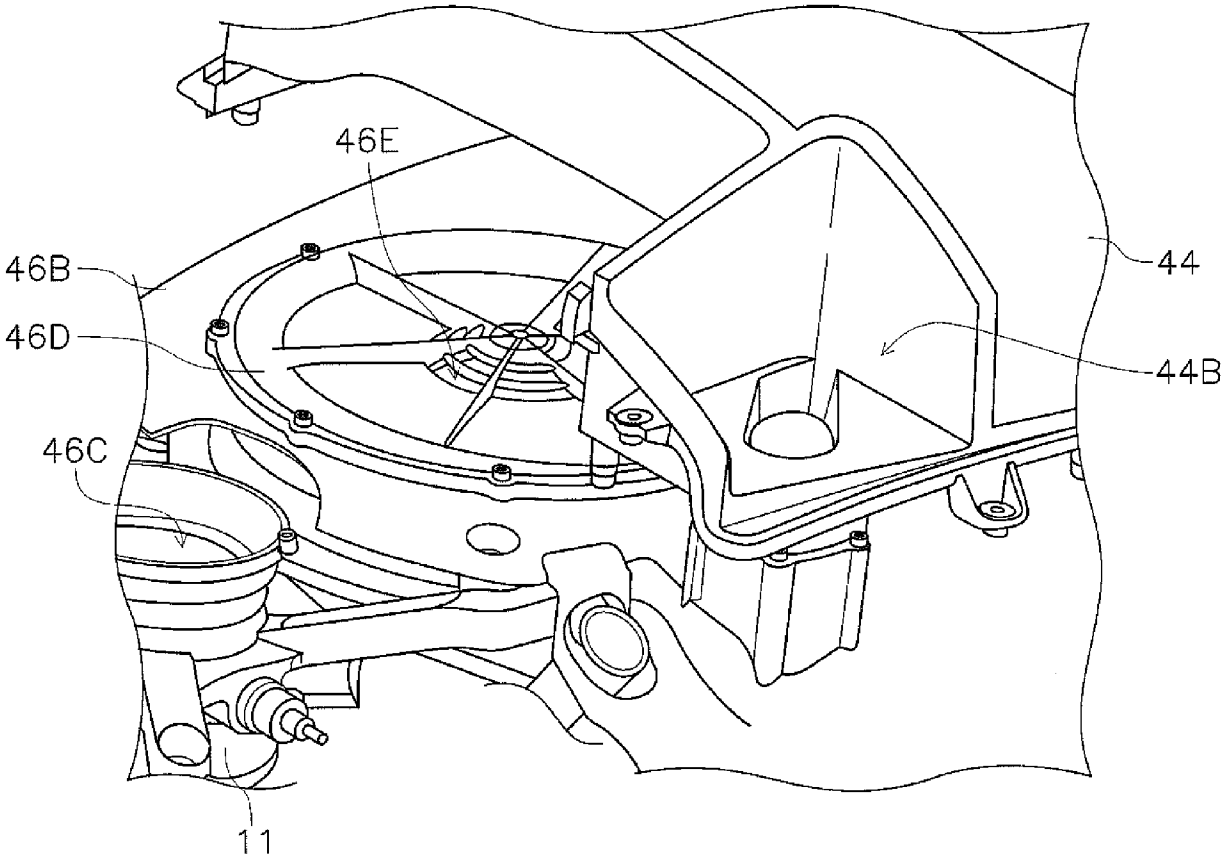
FIG. 6 is a view of FIG. 5 as seen from a direction of arrow X.
Figure 7:
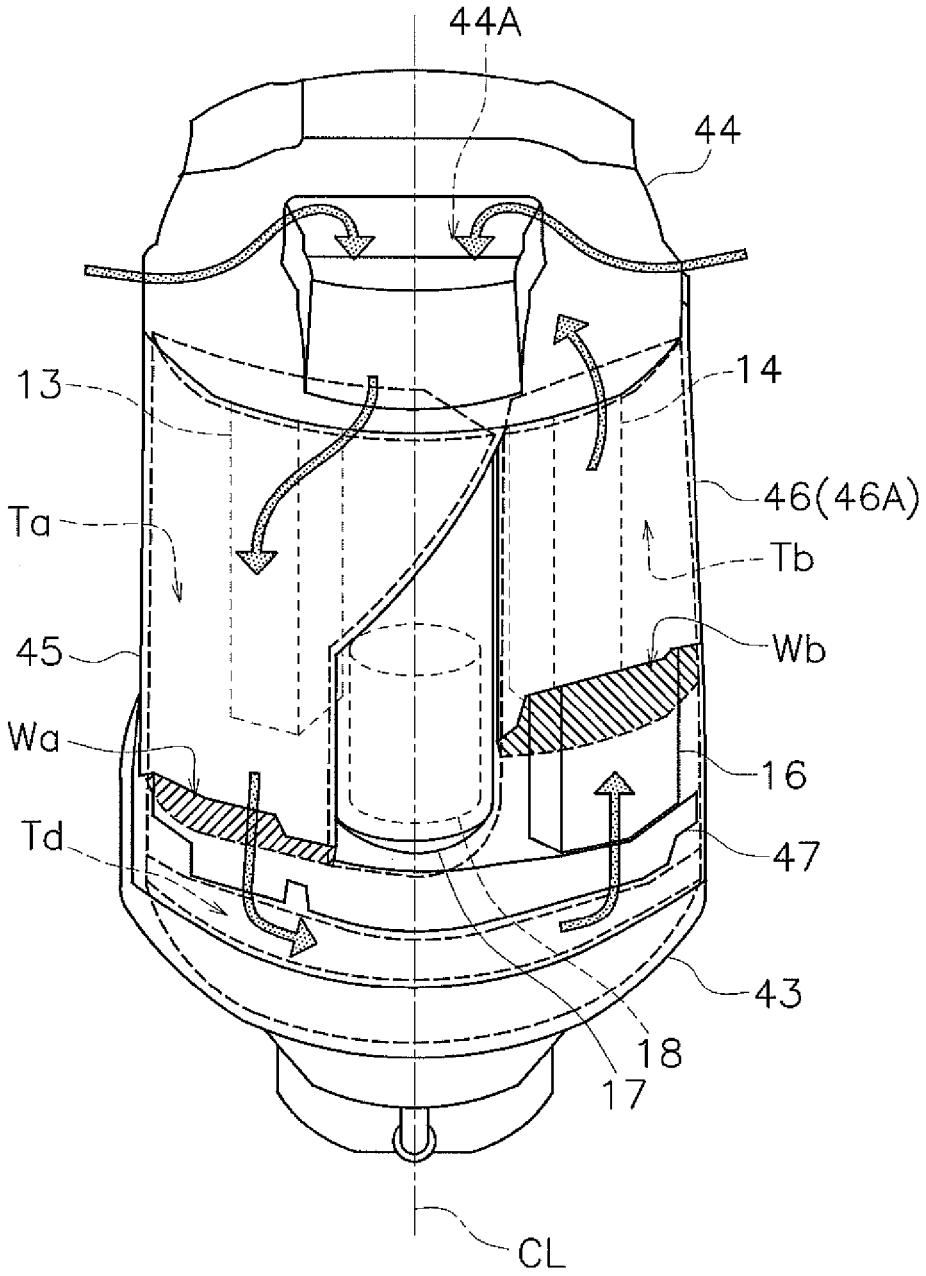
FIG. 7 is a schematic diagram of a construction of an intake path.
Figure 8:
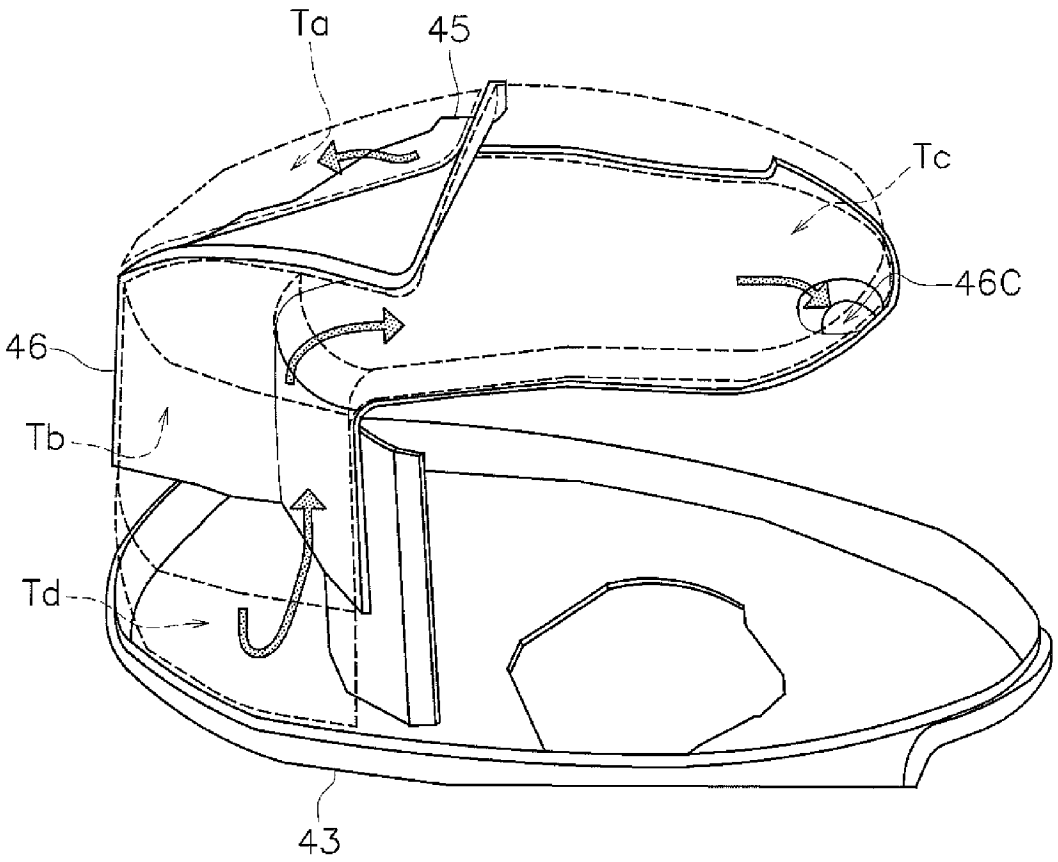
FIG. 8 is a schematic diagram of the construction of the intake path.

FIG. 3 is a rear perspective view of the engine cover 40. FIG. 4 is a front perspective view of the engine cover 40. FIG. 5 is an exploded perspective view of the engine cover 40. FIG. 6 is a view of FIG. 5 as seen from a direction of arrow X. FIGS. 7 and 8 are schematic diagrams of the construction of the intake path 40T. It should be noted that an upper cover 41 is not shown in FIGS. 7 and 8 for explaining the intake path 40T, and further, an inner lid 44 is also not shown in FIG. 8.

The engine cover 40 includes the upper cover 41, a lower cover 43, the inner lid 44, a first air duct member 45, a second air duct member 46, and a partition plate 47. The upper cover 41 includes an upper portion 411 and a lateral portion 412.

The intake path 40T includes a first airflow passage Ta, a second airflow passage Tb, a third airflow passage Tc, and an airflow space Tb. The external air flows through the first airflow passage Ta, the airflow space Td, the second airflow passage Tb, the third airflow passage Tc, in this order, and is then sucked into the engine 10.

The upper portion 411 is a lid-shaped exterior portion that covers the engine 10 from above. The upper portion 411 is disposed above the inner lid 44. The upper portion 411 preferably has a curved plate shape, and defines an upper surface 41S of the upper cover 41.

The lateral portion 412 is a tubular exterior portion that laterally encloses the engine 10. The lateral portion 412 is connected to the bottom of the upper portion 411. The lateral portion 412 defines a lateral surface 41T downwardly extending from the outer edge of the upper surface 41S. The lateral portion 412 includes a right opening 41A and a left opening 41B in the upper region thereof, and the right and left openings 41A and 41B are provided in the lateral surface 41T. The right and left openings 41A and 41B define and function as external air inlet ports that take in the external air to be introduced into the intake path 40T. As described below, the air from the fan 30 (see FIG. 6) is released from the front end of the right opening 41A.

The first and second air duct members 45 and 46 are attached inside the lateral portion 412. A space produced between the lateral portion 412 and the first air duct member 45 defines the first airflow passage Ta. A space produced between the lateral portion 412 and the second air duct member 46 defines the second airflow passage Tb. Thus, the inner surface of the lateral portion 412 defines the first airflow passage Ta and the second airflow passage Tb of the intake path 40T.

Front openings 41C are provided in the front surface of the lateral portion 412. The front openings 41C define and function as external air intake ports that take in the external air into the engine compartment 40S (see FIG. 1). Louvers 41D are attached to the front openings 41C.

The lower cover 43 is a lid-shaped exterior portion that covers the engine 10 from below. The lower cover 43 is connected to the bottom of the lateral portion 412. A space enclosed by the lower cover 43, the lateral portion 412, and the engine 10 defines the airflow space Td. Thus, the inner surface of the lower cover 43 and the inner surface of the lateral portion 412 define the airflow space Td of the intake path 40T. As shown in FIG. 7, the second head cover 16 is exposed between the partition plate 47 and the second air duct member 46. In the present preferred embodiment, the surface of the second head cover 16 also defines a portion of the airflow space Td.

The airflow space Td extends to the first airflow passage Ta and the second airflow passage Tb, and directs the external air from the first airflow passage Ta to the second airflow passage Tb. As shown in FIG. 7, the airflow space Td extends right and left across a right-and-left center line CL of the engine 10. The airflow space Td is located below or rearward of the exhaust pipe 17. The airflow space Td directs the external air, which flows therein from the first airflow passage Ta, to the right toward the second airflow passage Tb.

Moisture, contained in the external air flowing into the airflow space Td from the first airflow passage Ta, is attached to the inner surface of the lower cover 43 when the external air hits the lower cover 43. Therefore, the lower cover 43 includes a water drainage hole (not shown in the drawings).

The inner lid 44 is disposed between the upper portion 411 and the lateral portion 412. As shown in FIG. 5, the inner lid 44 includes an inlet port 44A in the middle of the rear end thereof. When taken in through the right and left openings 41A and 41B of the upper cover 41 (specifically, the lateral portion 412), the external air flows from the inlet port 44A toward the first air duct member 45. As shown in FIG. 6, the inner lid 44 includes a release port 44B in the left portion of the front end thereof. The release port 44B is an opening that releases the air from the fan 30 to the outside. The release port 44B is located laterally inside the left opening 41B of the upper cover 41.

The first air duct member 45 is disposed between the inner lid 44 and the lower cover 43. The first air duct member 45 downwardly extends from a position under the inlet port 44A and simultaneously curves leftward. A space between the first air duct member 45 and the lateral portion 412 defines the first airflow passage Ta. The first airflow passage Ta downwardly directs the external air flowing therein through the inlet port 44A.

The second air duct member 46 is disposed below the inner lid 44. The second air duct member 46 includes a first portion 46A and a second portion 46B.

The first portion 46A is disposed on the right side of the first air duct member 45. The first portion 46A extends in the up-and-down direction. The lower end of the first portion 46A is located higher than the lower end of the first air duct member 45. A space between the first portion 46A and the lateral portion 412 defines the second airflow passage Tb. The second airflow passage Tb upwardly directs the external air flowing therein from the airflow space Td.

As shown in FIG. 7, with reference to the right-and-left center line CL of the engine 10, the first airflow passage Ta is disposed on the left side whereas the second airflow passage Tb is disposed on the right side. Likewise, with reference to the catalyst 18 embedded in the exhaust pipe 17, the first airflow passage Ta is disposed on the left side whereas the second airflow passage Tb is disposed on the right side. The first airflow passage Ta is disposed rearward of the four first cylinders 13, whereas the second airflow passage Tb is disposed rearward of the four second cylinders 14.

The lower end of the first portion 46A is located higher than that of the first air duct member 45. Hence, the lower end of the second airflow passage Tb is located higher than that of the first airflow passage Ta. The horizontal cross-sectional area Wb of the second airflow passage Tb is larger than that the horizontal cross-sectional area Wa of the first airflow passage Ta. Therefore, the flow rate of the external air in the second airflow passage Tb is slower than that of the external air in the first airflow passage Ta.

The second portion 46B forwardly extends from the upper end of the first portion 46A. The second portion 46B includes an airflow port 46C provided in the front end thereof. The airflow port 46C is connected to the throttle body 11 of the engine 10. A cover member 46D is attached to the middle of the second portion 46B. The cover member 46D is disposed above the fan 30. A space between the second portion 46B and the inner lid 44 defines the third airflow passage Tc. The third airflow passage Tc forwardly directs the external air flowing therein from the second airflow passage Tb. When forwardly flowing through the third airflow passage Tc, the external air is sucked into the throttle body 11 through the airflow port 46C.

As shown in FIG. 6, the cover member 46D is attached to the middle of the second portion 46B so as to be disposed above the fan 30. A first suction port 46E is provided in the cover member 46D in order to suck in air existing above the cover member 46D into the fan 30 (see FIG. 1). The air above the cover member 46D downwardly passes through the first suction port 46E and flows into the fan 30.

Figure 9:
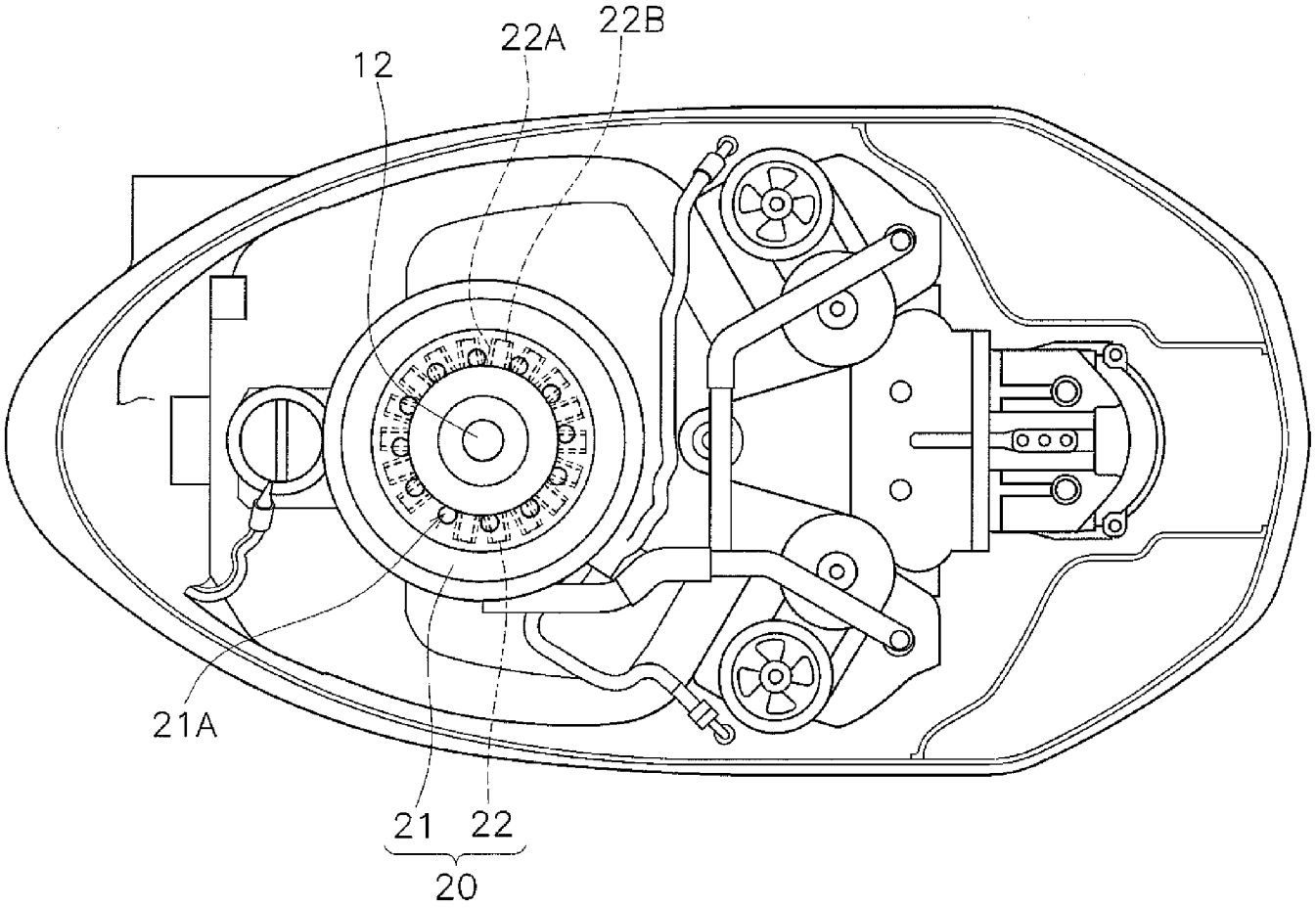
FIG. 9 is a cross-sectional view of FIG. 1 taken along line 9-9.

The partition plate 47 is preferably a plate shaped member fixed to the lower cover 43. The partition plate 47 is disposed below the first air duct member 45 and the second air duct member 46, and is also disposed between the engine 10 and the airflow space Td. Thus, in the present preferred embodiment, the surface of the partition plate 47 also defines a portion of the airflow space Td. FIG. 9 is a cross-sectional view of FIG. 1 taken along line 9-9. The flywheel magnet generator 20 includes the flywheel rotor 21 and the stator 22.

The flywheel rotor 21 is attached to the upper end of the crankshaft 12. The flywheel rotor 21 is a lid-shaped member that opens downward. The flywheel rotor 21 includes a plurality of magnets fixed to the inner peripheral surface thereof. The plurality of magnets are disposed concentrically to the stator 22 so as to be opposed thereto.

The stator 22 is disposed between the engine 10 and the flywheel rotor 21. The stator 22 is disposed inside the flywheel rotor 21, and is disposed concentrically to the plurality of magnets so as to be opposed thereto. The stator 22 includes a plurality of cores 22A and a plurality of coils 22B. Each coil 22B is wound about the outer periphery of each core 22A.

The flywheel rotor 21 includes a plurality of second suction ports 21A provided in the upper surface thereof so as to suck in air toward the fan 30 from below the flywheel rotor 21. The plurality of second suction ports 21A are aligned concentrically to the stator 22. The plurality of second suction ports 21A are located above the stator 22. Air heated by the stator 22 upwardly passes through the plurality of second suction ports 21A and flows toward the fan 30.

Figure 10:
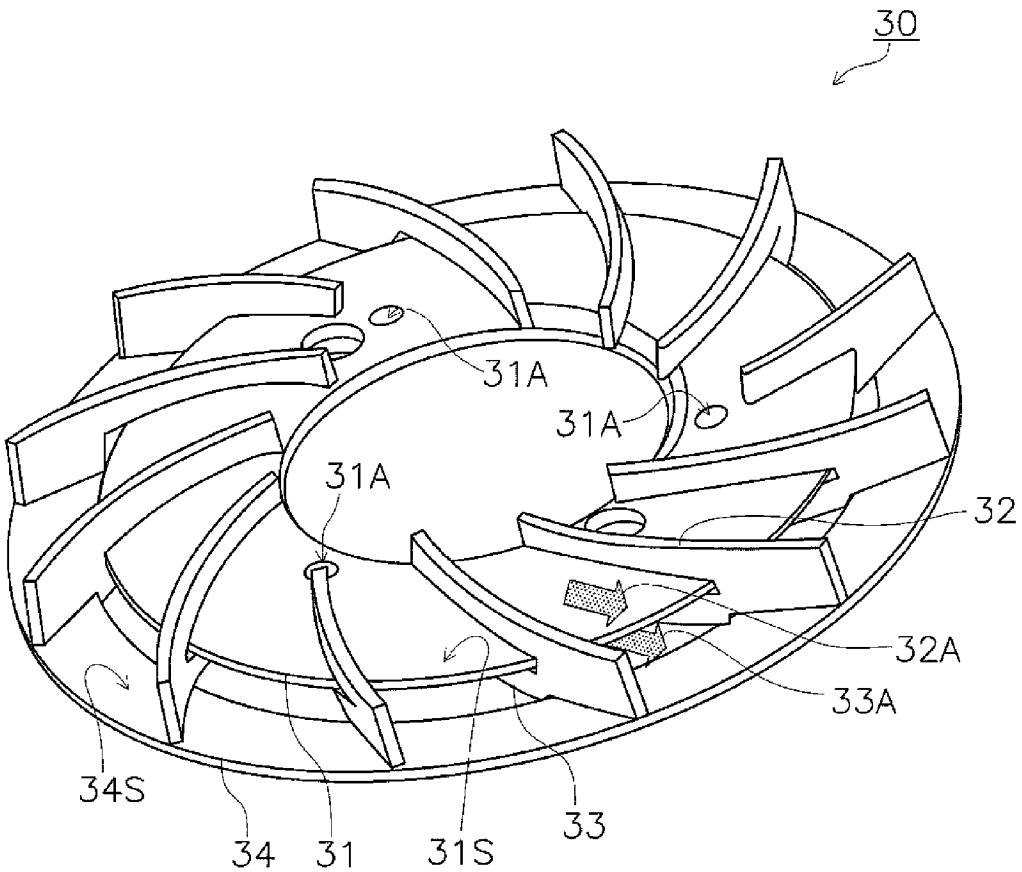
FIG. 10 is an upper perspective view of a fan.
Figure 11:
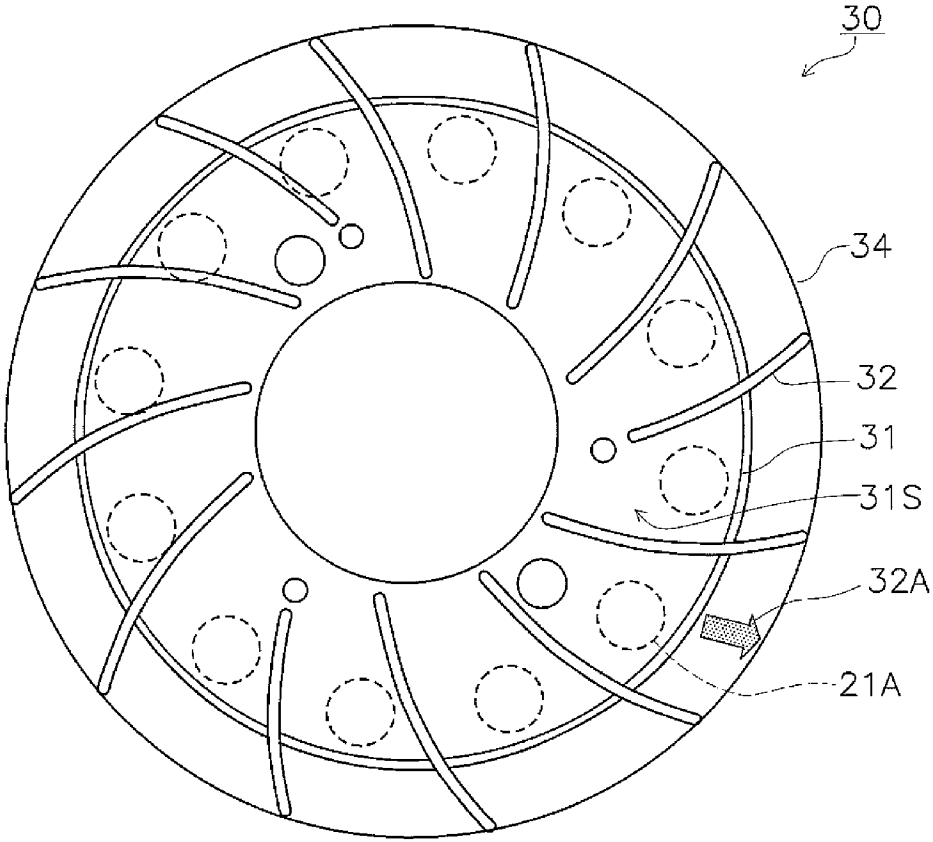
FIG. 11 is a top view of the fan.
Figure 12:
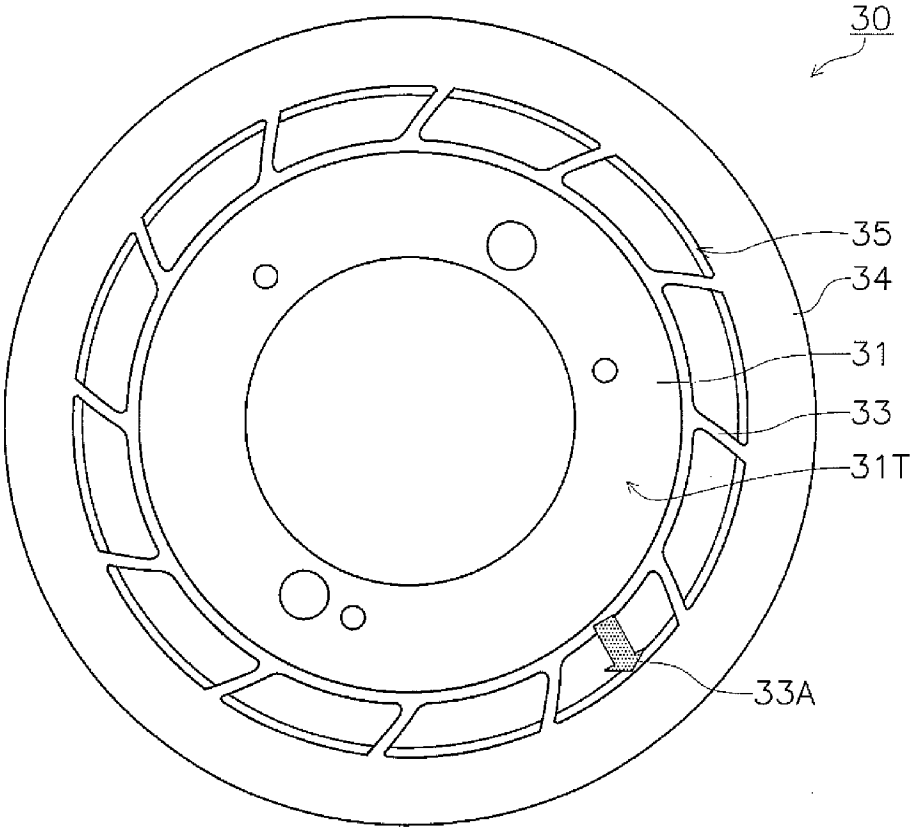
FIG. 12 is a bottom view of the fan.

FIG. 10 is a top perspective view of the fan 30. FIG. 11 is a top view of the fan 30. FIG. 12 is a bottom view of the fan 30.

The fan 30 includes an annular member 31, a plurality of upper blades 32, a plurality of lower blades 33, and a reinforcement member 34.

The annular member 31 has an annular shape and is disposed about the axis of the crankshaft 12. The annular member 31 includes three bolt holes 31A, for example, and is fixed to the flywheel rotor 21 by three bolts, for example, inserted through the bolt holes 31A. Therefore, the annular member 31 is rotated together with the flywheel rotor 21 in conjunction with the rotation of the crankshaft 12.

The plurality of upper blades 32 are disposed on an upper surface 31S of the annular member 31. As shown in FIG. 11, a plurality of first ventilation paths 32A are provided between adjacent ones of the plurality of upper blades 32. The first ventilation paths 32A are airflow passages that release air sucked in through the first suction port 46E (see FIG. 6) of the cover member 46D to radially outward directions about the axis of the crankshaft 12. In the present preferred embodiment, twelve first ventilation paths 32A, for example, are preferably provided among twelve upper blades 32.

Each upper blade 32 preferably has a curved shape in a top view of the annular member 31. Each upper blade 32 extends in a direction intersecting with the radial direction. Due to this configuration, each first ventilation path 32A also extends in the direction intersecting with the radial direction. Each upper blade 32 extends further radially outward than the outer edge of the annular member 31. Each upper blade 32 protrudes radially outward from the outer edge of the annular member 31. Due to this configuration, each first ventilation path 32A also extends radially outward from the outer edge of the annular member 31. It should be noted that the upper blades 32 are preferably integrally molded with the annular member 31.

The plurality of lower blades 33 are disposed on a lower surface 31T of the annular member 31. As shown in FIG. 12, a plurality of second ventilation paths 33A are provided on the lower surface 31T of the annular member 31 by gaps between adjacent ones of the plurality of lower blades 33. The second ventilation paths 33A are airflow passages that radially outwardly release air sucked in through the plurality of second suction ports 21A (see broken lines in FIG. 11) of the flywheel rotor 21. In the present preferred embodiment, twelve second ventilation paths 33A, for example, are preferably provided among twelve lower blades 33.

Each lower blade 33 preferably has a curved shape in a bottom view of the annular member 31. Each lower blade 33 extends in a direction intersecting with the radial direction. Due to this configuration, each second ventilation path 33A also extends in the direction intersecting with the radial direction. Each lower blade 33 extends further radially outward than the outer edge of the annular member 31. Each lower blade 33 protrudes radially outward from the outer edge of the annular member 31. Due to this configuration, each second ventilation path 33A also extends radially outward from the outer edge of the annular member 31. The lower blades 33 are preferably integrally molded with the annular member 31.

In the present preferred embodiment, the lower blades 33 and the upper blades 32 are preferably integral and unitary with each other. Thus, the first ventilation paths 32A and the second ventilation paths 33A are provided on the opposite sides through the annular member 31.

The reinforcement member 34 preferably has an annular shape and is disposed on the radial outside of the annular member 31. As shown in FIG. 10, the plurality of lower blades 33 are joined to an upper surface 34S of the reinforcement member 34. With this construction, the reinforcement member 34 enhances the entire strength of the fan 30. The reinforcement member 34 is spaced apart from the annular member 31 so as not to block airflow from the second suction ports 21A to the second ventilation paths 33A. Thus, intake ports 35 are provided between the reinforcement member 34 and the annular member 31.

Figure 13:
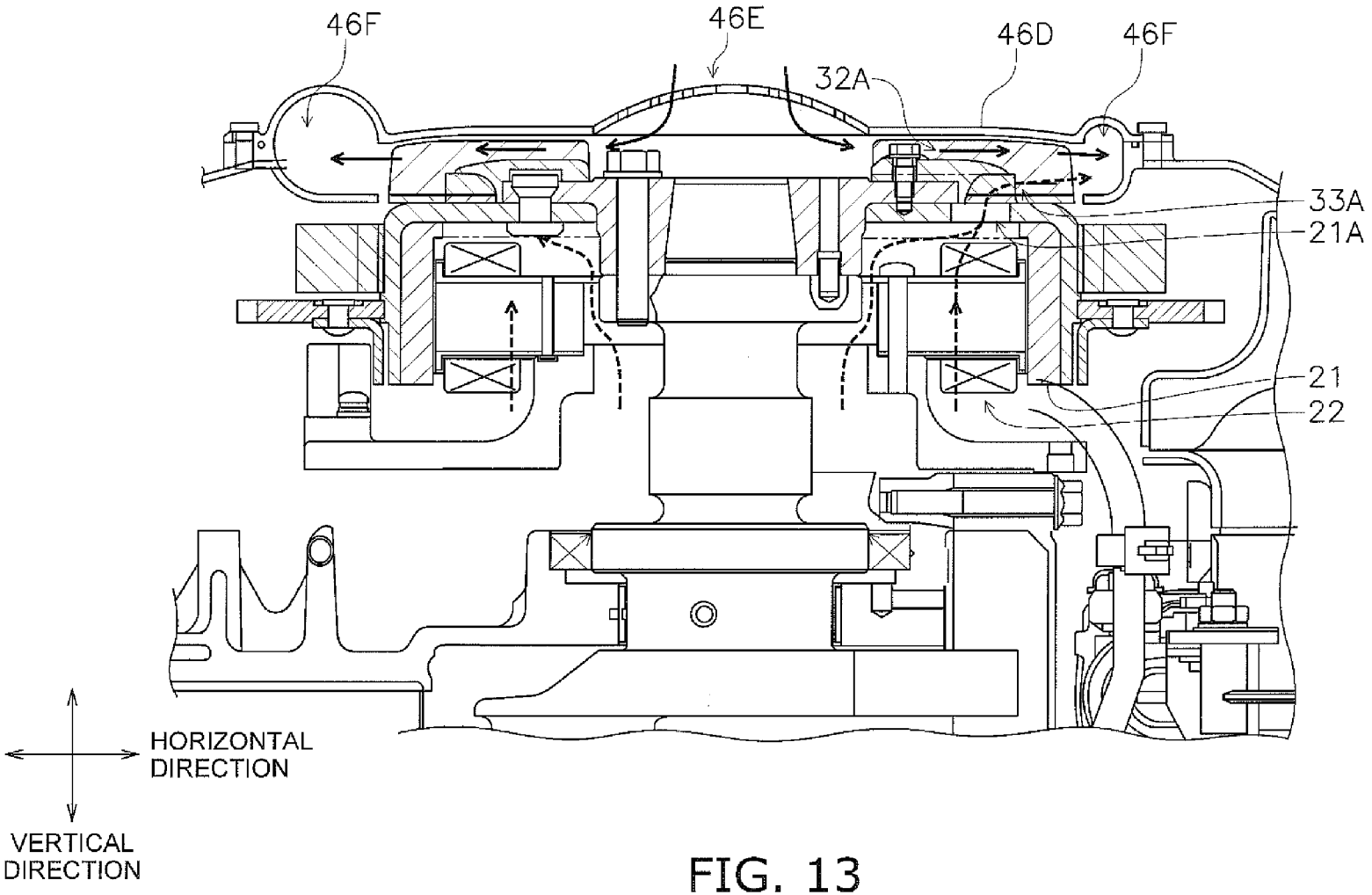
FIG. 13 is a schematic diagram explaining the flow of air from the fan.
Figure 14:
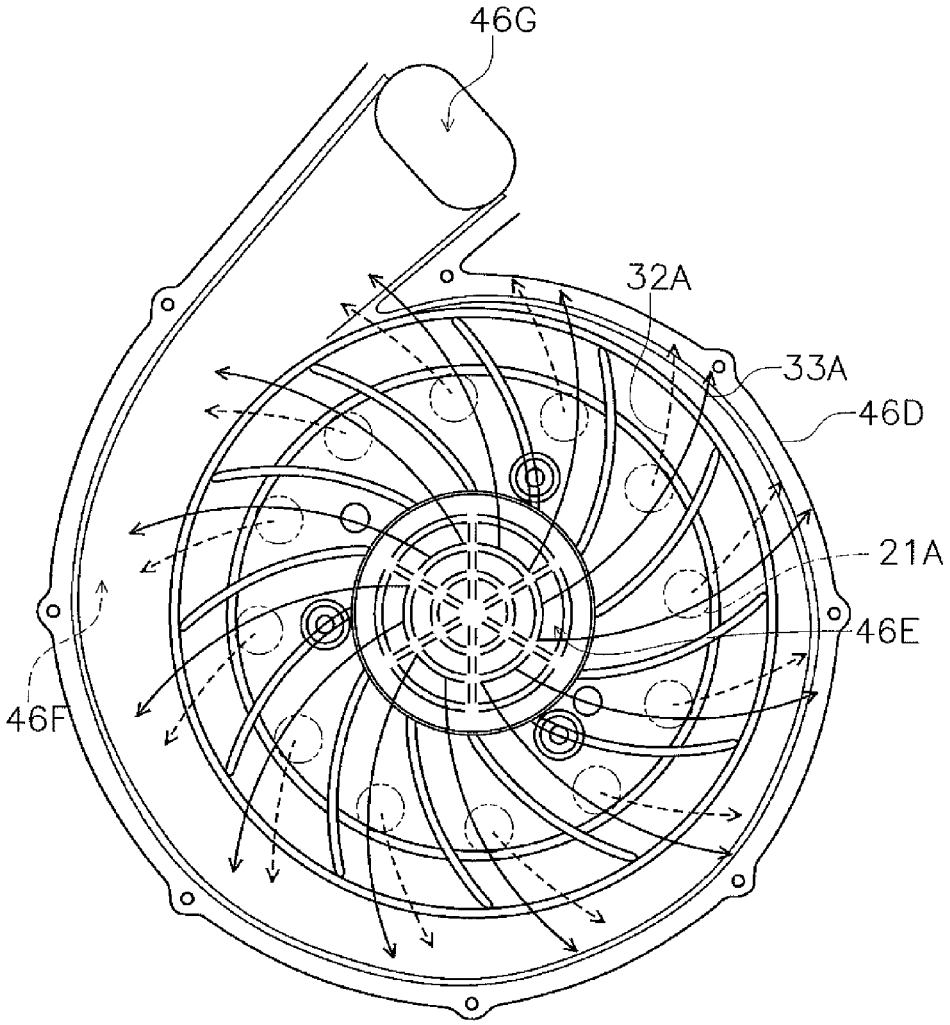
FIG. 14 is a schematic diagram explaining the flow of air from the fan.
Figure 15:
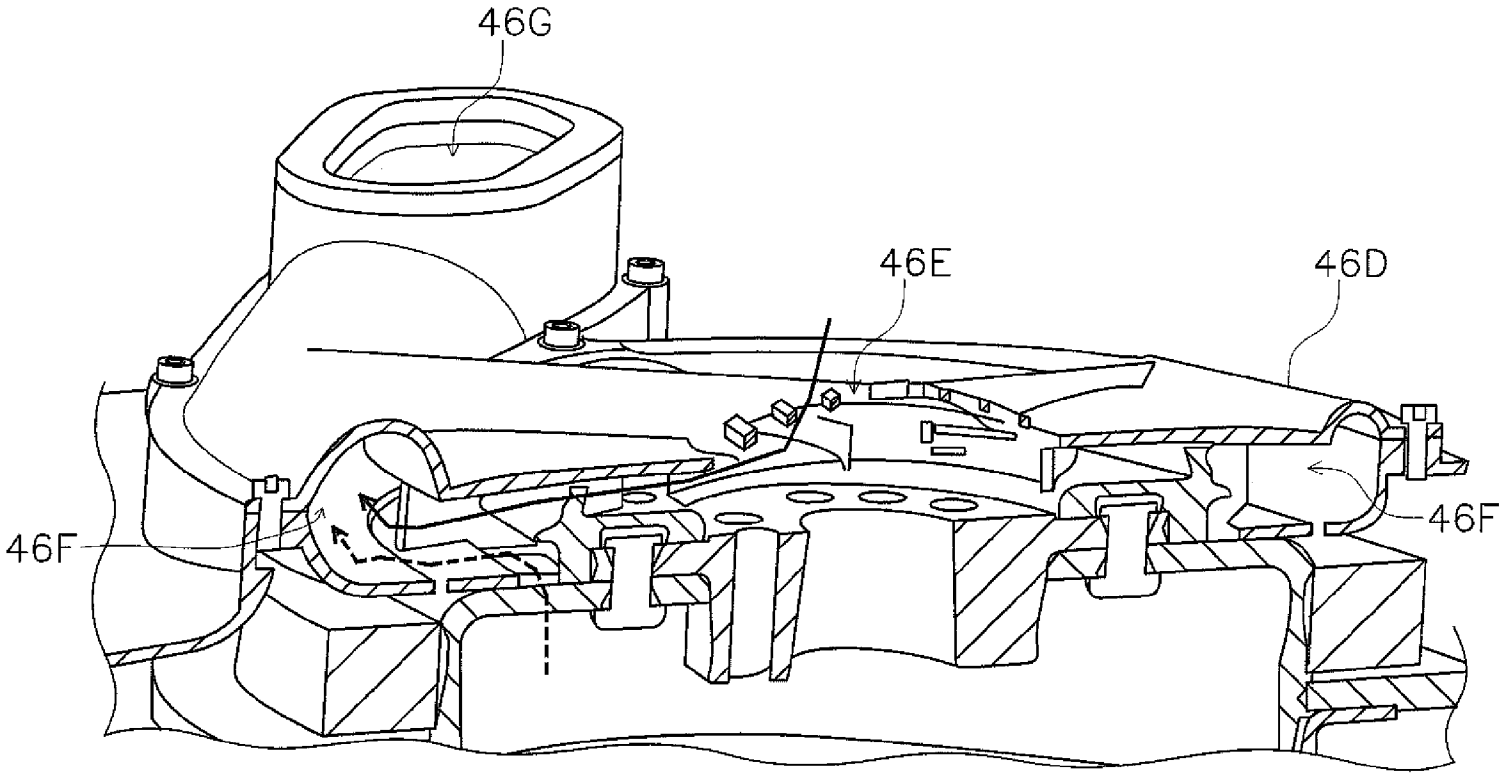
FIG. 15 is a schematic diagram explaining the flow of air from the fan.

FIGS. 13 to 15 are schematic diagrams for explaining the flow of air from the fan 30. In FIGS. 13 to 15, the flow of air from the first suction port 46E to the first ventilation paths 32A is depicted with solid-line arrows, whereas the flow of air from the second suction ports 21A to the second ventilation paths 33A is depicted with broken-line arrows.

Warm air inside the engine cover 40 is taken in through the first suction port 46E into the fan 30. Air inside the engine compartment 40S, warmed by the engine 10 and the flywheel magnet generator 20, is taken in through the second suction ports 21A into the fan 30. As shown in FIGS. 13 and 14, the first suction port 46E and the second suction ports 21A are horizontally spaced apart from each other, and simultaneously, are divided by the annular member 31 in the vertical direction. This construction prevents interference between the air taken in through the first suction port 46E and the air taken in through the second suction ports 21A.

The air taken in through the first suction port 46E passes through the first ventilation paths 32A above the annular member 31 and is released radially outward. The air taken in through the second suction ports 21A passes through the second ventilation paths 33A below the annular member 31 and is released radially outward.

The air released from the first ventilation paths 32A and the air released from the second ventilation paths 33A join together in a cylindrical ventilation passage 46F on the outer periphery of the cover member 46D, and circumferentially flow within the ventilation passage 46F.

The ventilation passage 46F continues to a ventilation port 46G in the upper surface of the cover member 46D. The ventilation port 46G is coupled to the release port 44B (see FIG. 6) in the inner lid 44 of the engine cover 40. Therefore, the air flowing within the ventilation passage 46F passes through the ventilation port 46G and the release port 44B, and is released to the outside of the upper cover 41 through the left opening 41B.

The cover member 46D includes the first suction port 46E to suck air into the fan 30 from above the cover member 46D. The flywheel rotor 21 includes the second suction ports 21A to suck air into the fan 30 from below the flywheel rotor 21. The fan 30 includes the first ventilation paths 32A and the second ventilation paths 33A. The first ventilation paths 32A release the air sucked in through the first suction port 46E to the radially outward directions of the fan 30, whereas the second ventilation paths 33A release the air sucked in through the second suction ports 21A to the radially outward directions of the fan 30.

According to the fan 30 described above, the warm air inside the engine cover 40 is taken in through the first suction port 46E, and simultaneously, the air warmed by the engine 10 and the flywheel magnet generator 20 is taken in through the second suction ports 21A. Therefore, the warm air inside the engine cover 40 is efficiently taken in and released to the outside.

The fan 30 includes the annular member 31, the plurality of upper blades 32 disposed on the upper surface 31S of the annular member 31, and the plurality of lower blades 33 disposed on the lower surface 31T of the annular member 31.

Therefore, the first ventilation paths 32A and the second ventilation paths 33A have a simple construction.

When seen in the vertical direction, the first suction port 46E and the second suction ports 21A are horizontally spaced apart from each other.

Therefore, it is possible to prevent interference between the air taken in through the first suction port 46E and the air taken in through the second suction ports 21A.

The first ventilation paths 32A and the second ventilation paths 33A respectively extend to the ventilation passage 46F.

Therefore, the fan 30 has a more simple construction than when the first ventilation paths 32A and the second ventilation paths 33A are separately connected to the release port 44B of the engine cover 40.

Other Preferred Embodiments

The present invention has been described with respect to the above preferred embodiments. However, it should be understood that the description and drawings, forming a part of this original disclosure, are not intended to limit the present invention. A variety of alternative preferred embodiments, practical examples, and operational techniques would be apparent for those skilled in the art from this disclosure.

In the above-described preferred embodiments, the upper portion 411 and the lateral portion 412 are preferably integral and unitary. However, the upper portion 411 and the lateral portion 412 may be separate members.

Figure 16:
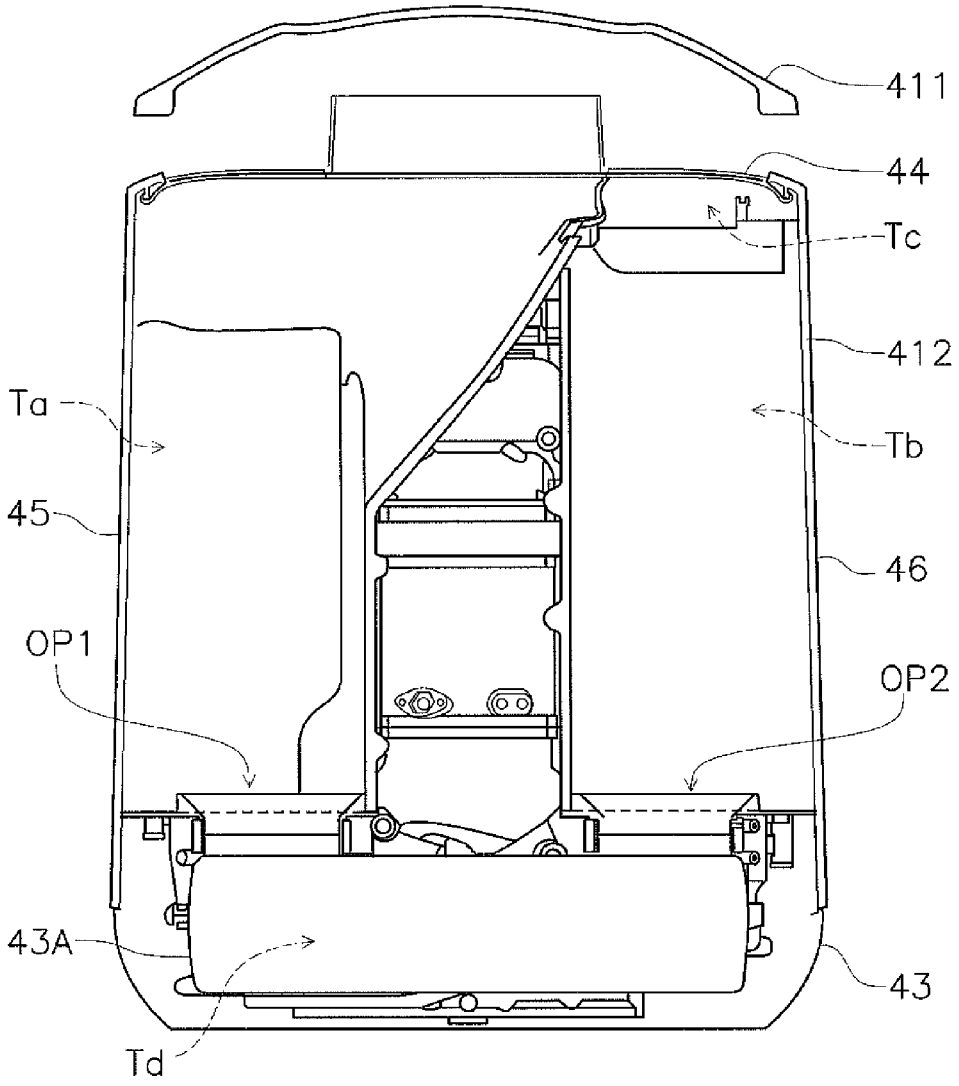
FIG. 16 is a schematic diagram of an intake path having another construction.

In the above-described preferred embodiments, the airflow space Td is preferably defined by the inner surface of the lower cover 43. However, the construction of the airflow space Td is not limited to the above. The airflow space Td is only required to be provided above the lower cover 43. For example, as shown in FIG. 16, the airflow space Td may be provided in the interior of an airflow pipe 43A. The airflow pipe 43A is disposed along the right-and-left direction. The airflow pipe 43A includes a first opening OP1 and a second opening OP2. The first opening OP1 is open in the lower end of the first airflow passage Ta, whereas the second opening OP2 is open in the lower end of the second airflow passage Tb. With the use of the airflow pipe 43A thus constructed, it is possible to provide the airflow space Td to direct the external air from the first airflow passage Ta to the second airflow passage Tb.

In the above-described preferred embodiments, the engine 10 is preferably a V-type eight-cylinder engine, for example. However, the construction of the engine 10 is not limited to the above. The engine 10 may be an inline engine, a parallel engine or so forth, and additionally, an arbitrary number of cylinders may be selected.

In the above-described preferred embodiments, the upper blades 32 and the lower blades 33 preferably have curved shapes in a plan view. However, the shapes of the upper blades 32 and the lower blades 33 are not limited to the above. The upper blades 32 and the lower blades 33 may have various shapes such as a straight shape and a corrugated shape.

In the above-described preferred embodiments, the upper blades 32 and the lower blades 33 are respectively integrally molded with the annular member 31. However, the structural relationship between the upper and lower blades 32 and 33 and the annular member 31 is not limited to the above. The upper blades 32 and the lower blades 33 may be separate from the annular member 31. In this construction, the upper blades 32 and the lower blades 33 may be respectively fixed to the annular member 31 by bolts and/or so forth.

In the above-described preferred embodiments, the upper blades 32 and the lower blades 33 are preferably matched in phase in the circumferential direction about the axis of the crankshaft 12. However, the phase relationship between the upper blades 32 and the lower blades 33 is not limited to the above. For example, the upper blades 32 and the lower blades 33 may not be matched in phase at their portions that are connected to the annular member 31.

In the above-described preferred embodiments, the twelve first ventilation paths 32A are preferably provided among the twelve upper blades 32, whereas the twelve second ventilation paths 33A are preferably provided among the twelve lower blades 33. However, the number of the first ventilation paths 32A and the number of the second ventilation paths 33A are not limited to the above. The number of the first ventilation paths 32A and the number of the second ventilation paths 33A can be arbitrarily changed by changing the number of the upper blades 32 and the number of the lower blades 33.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a crankshaft extending in a vertical direction;

a flywheel magnet generator including a flywheel rotor, a core, and a coil, the flywheel rotor being attached to an end of the crankshaft, and the core and the coil being located between the flywheel rotor and the engine;

a fan attached to the flywheel rotor; and a cover member located above the fan; wherein the cover member includes a first suction port that sucks in air from above the cover member;

the flywheel rotor includes a second suction port that sucks in air from below the flywheel rotor;

the fan includes a first ventilation path and a second ventilation path, the first ventilation path releasing radially outwardly the air sucked in through the first suction port, and the second ventilation path releasing radially outwardly the air sucked in through the second suction port;

the fan includes an annular member, a plurality of upper blades, and a plurality of lower blades;

the annular member is located about an axis of the crankshaft;

the plurality of upper blades are provided on an upper surface of the annular member; and the plurality of lower blades are provided on a lower surface of the annular member.

2. The outboard motor according to claim 1, wherein the first ventilation path is defined by gaps between adjacent blades of the plurality of upper blades.

3. The outboard motor according to claim 2, wherein the first ventilation path is located above the upper surface of the annular member.

4. The outboard motor according to claim 1, wherein the second ventilation path is defined by gaps between adjacent blades of the plurality of lower blades.

5. The outboard motor according to claim 4, wherein the second ventilation path is located below the lower surface of the annular member.

6. The outboard motor according to claim 1, wherein the first suction port and the second suction port are spaced apart from each other when viewed from a vertical direction.

7. The outboard motor according to claim 1, further comprising:

an engine cover accommodating the engine, the flywheel magnet generator, and the fan; wherein the cover member includes a ventilation passage extending to a release port provided in the engine cover; and the first ventilation path and the second ventilation path extend to the ventilation passage.

8. The outboard motor according to claim 7, wherein the engine cover includes an engine compartment and an intake path;

the engine compartment accommodates the engine, the flywheel magnet generator, and the fan;

the intake path directs external air to the engine; and the ventilation passage is located in the engine compartment.

9. The outboard motor according to claim 1, wherein the plurality of upper blades and the plurality of lower blades respectively extend in directions intersecting with radial directions about the axis of the crankshaft in a top view of the annular member.

10. The outboard motor according to claim 9, wherein the plurality of upper blades and the plurality of lower blades respectively curve in the top view of the annular member.

11. The outboard motor according to claim 9, wherein the plurality of upper blades and the plurality of lower blades extend outward of an outer edge of the annular member.

12. The outboard motor according to claim 9, wherein the plurality of upper blades are integral with the plurality of lower blades on a one-to-one basis.

13. A watercraft comprising:

a hull; and the outboard motor recited in claim 1; wherein the outboard motor is attached to the hull.

* * * * *